US011345983B2

(12) United States Patent
Sourav et al.

(10) Patent No.: US 11,345,983 B2
(45) Date of Patent: May 31, 2022

(54) BAINITIC STEEL OF HIGH STRENGTH AND HIGH ELONGATION AND METHOD TO MANUFACTURE SAID BAINITIC STEEL

(75) Inventors: Das Sourav, Jamshedpur (IN); Kundu Saurabh, Jamshedpur (IN); Halder Arunansu, Jamshedpur (IN)

(73) Assignee: Tata Steel Limited, Jamshedpur (IN)

( * ) Notice: Subject to any disclaimer, the term of this patent is extended or adjusted under 35 U.S.C. 154(b) by 516 days.

(21) Appl. No.: 14/112,381

(22) PCT Filed: May 28, 2012

(86) PCT No.: PCT/IN2012/000371
§ 371 (c)(1),
(2), (4) Date: Jan. 6, 2014

(87) PCT Pub. No.: WO2012/164579
PCT Pub. Date: Dec. 6, 2012

(65) Prior Publication Data

US 2014/0102600 A1 Apr. 17, 2014

(30) Foreign Application Priority Data

May 30, 2011 (IN) ..... 736/KOL/2011

(51) Int. Cl.
*C22C 38/58* (2006.01)
*C21D 9/52* (2006.01)
(Continued)

(52) U.S. Cl.
CPC ..... *C22C 38/58* (2013.01); *C21D 1/20* (2013.01); *C21D 8/005* (2013.01); *C21D 8/0226* (2013.01);
(Continued)

(58) Field of Classification Search
CPC ..... C22C 38/02
(Continued)

(56) References Cited

U.S. PATENT DOCUMENTS 6,254,696 B1 7/2001 Ueda et al.
6,364,968 B1 4/2002 Yasuhara et al.
(Continued)

FOREIGN PATENT DOCUMENTS

CN 101586216 A 11/2009
EP 2310545 A2 4/2011
(Continued)

OTHER PUBLICATIONS

Bhadeshia, Properties of fine-grained steels generated by displacive transformation, Materials Science and Engineering A, 2008, pp. 36-39, vols. 481-482.
(Continued)

*Primary Examiner* — Brian D Walck
(74) *Attorney, Agent, or Firm* — Venable LLP; Keith G. Haddaway; Elizabeth C. G. Gitlin

(57) ABSTRACT

The invention relates to a bainite steel consisting of the following elements in weight %: C: 0.25-0.55 Si: 0.5-1.8 Mn: 0.8-3.8 Cr: 0.2-2.0 Ti: 0.0-0.1 Cu: 0.0-1.2 V: 0.0-0.5 Nb: 0.0-0.06 Al: 0.0-2.75 N: <0.004 P: <0.025 S: <0.025 and a method for manufacturing a bainite steel strip that comprises the step of cooling the coiled strip of such composition to ambient temperature, during which the bainite transformation takes place.

13 Claims, 5 Drawing Sheets

(51) Int. Cl.

| | |
|---|---|
| ***C21D 8/02*** | (2006.01) |
| ***C21D 1/20*** | (2006.01) |
| ***C21D 8/00*** | (2006.01) |
| ***C22C 38/02*** | (2006.01) |
| ***C22C 38/06*** | (2006.01) |
| ***C22C 38/44*** | (2006.01) |
| ***C22C 38/50*** | (2006.01) |
| ***C22C 38/52*** | (2006.01) |

(52) U.S. Cl.
CPC ..... *C21D 9/52* (2013.01); *C22C 38/02* (2013.01); *C22C 38/06* (2013.01); *C22C 38/44* (2013.01); *C22C 38/50* (2013.01); *C22C 38/52* (2013.01)

(58) Field of Classification Search
USPC ..... 148/332, 333, 546, 602
See application file for complete search history.

(56) References Cited

U.S. PATENT DOCUMENTS

| | | | | |
|---|---|---|---|---|
| 2008/0295923 | A1 | 12/2008 | Lee et al. | |
| 2010/0307641 | A1* | 12/2010 | Im | C21D 1/20 148/506 |

FOREIGN PATENT DOCUMENTS

| | | | |
|---|---|---|---|
| EP | 2559783 | A1 | 2/2013 |
| EP | 2614171 | B1 | 7/2013 |
| JP | 734133 | A | 2/1995 |
| JP | 2002-363698 | A | 12/2002 |
| WO | 96/22396 | A1 | 7/1996 |

OTHER PUBLICATIONS

Caballero et al., Very strong low temperature bainite, Materials Science and Technology, Mar. 2002, pp. 279-284, vol. 18.

Caballero et al., Design of Advanced Bainitic Steels by Optimisation of TTT Diagrams and $T_0$ Curves, ISIJ International, 2006, pp. 1479-1488, vol. 46, No. 10.

Caballero et al., Theoretical design and advanced microstructure in super high strength steels, Materials and Design, 2009, pp. 2077-2083, vol. 30.

Garcia-Mateo et al., Low-temperature bainite, Journal de Physique IV, 2003, pp. 285-288, vol. 112.

Gomez et al., Strong Bainitic Steels by Continuous Cooling Transformation, International Conference on New Developments on Metallurgy and Applications of High Strength Steel, 2008, pp. 1-12.

Wegst, Stahlschlussel-Taschenbuch, Verlag Stahlschlussel Wegst, 1998, pp. 145-146.

Singh et al., "Estimation of bainite plate-thickness in low-alloy steels", Materials Science and Engineering A245 (1998), pp. 72-79.

Sourav et al., Development of continuously cooled high strength bainitic steel through microstructural engineering at Tata steel, Materials Science Forums, (2012) vols. 702-703, pp. 939-942.

* cited by examiner

BAINITIC STEEL OF HIGH STRENGTH AND HIGH ELONGATION AND METHOD TO MANUFACTURE SAID BAINITIC STEEL

CROSS-REFERENCE TO RELATED APPLICATIONS

This application is the United States national phase of International Application No. PCT/IN2012/000371 filed May 28, 2012, and claims priority to Indian Patent Application No. 736/KOL/2011 filed May 30, 2011, the disclosures of which are hereby incorporated by reference in their entirety.

BACKGROUND OF THE INVENTION

Field of the Invention

The present invention relates to high strength bainitic steel with a minimum to ultimate tensile strength (UTS) of 1300 MPa and an elongation of at least 20% as well as to a method for manufacturing such a steel. The bainitic steel according to the invention is suitable for use in the automotive industry as well as for other structural applications.

Description of Related Art

Environmental concerns in the recent times are forcing automobile industries to reduce the weight of the vehicles by lowering down the thickness of the steels used in different parts of an automobile. However, this weight reduction may not compromise passenger safety. Passenger safety is directly related to the energy absorbed during any possible collision and in turn related to the steel thickness for the same strength level. One way of achieving both conditions (reducing the weight of the automobile and stringent safety parameters) can be met by using higher strength steel grade. Thus, the challenge is to develop stronger steel with better ductility.

Several high strength and high elongation steel grades, providing a wide range of strength/elongation combination from 600-1400 MPa UTS with 30-5% elongation, are available worldwide. However, in most cases when the strength of the steel goes up the elongation value goes down and it is difficult to achieve a good combination of high strength and at the same time high elongation.

In the prior art bainitic steel is disclosed with nano-structured bainitic microstructure and C-enriched austenite which can provide very high strengths of about 2200 MPa but with a maximum elongation of approximately 7%. See for instance:

C. G. Mateo, F. G. Caballero and H. K. D. Bhadeshia, *Journal de Physique IV*, Vol. 112, pp. 285-288, 2003;

F. G. Caballero, H. K. D. Bhadeshia, K. J. A. Mawella, D. G. Jones and P. Brown, *Materials Science and Technology*, Vol. 18, pp. 279-284, 2002, and H. K. D. H. Bhadeshia, *Materials Science and Engineering A*, Vol. 481-482, pp. 36-39, 2008.

In the composition of these known bainitic steels about 0.9 wt % C is used in combination with costly alloying elements like Co and Ni. The steel is rapidly cooled from austenite region to avoid any diffusional transformation and isothermally transformed to bainitic steel by holding at a certain temperature or temperature range for a long time, for instance 7 days at 200° C.

Although high strength bainitic steel with lower C are known also, these steels however have a composition with high amounts of costly alloying elements like Ni and Mo. See for instance:

F. G. Caballero, M. J. Santofima, C. Capdevila, C. G.-Mateo and C. G. De Andres, *ISIJ International*, Vol. 46, pp. 1479-1488, 2006, and F. G. Caballero, M. J. Santofima, C. G.-Mateo J. Chao and C. G. De Andres, *Materials and Design*, Vol. 30, pp. 2077-2083, 2009.

According to prior art methods to manufacture bainitic steel, the steel is held under isothermal conditions for a prolonged period of time to maximize the bainitic transformation. However, due to slower kinetics at lower temperature such methods are not ideal for continuous production of bainitic steel sheets and, moreover, due to the prolonged period of time the process becomes very energy intensive.

Air-cooled bainitic steel is known from the works by G. Gomez, T. Perez and H. K. D. H. Bhadeshia, *Strong steels by continuous cooling transformation* in "International Conference on New Developments on Metallurgy and Applications of High Strength Steels", Buenos Aires, Argentina, 2008. This bainitic steel is obtained through continuous air cooling after hot rolling and the final product has a UTS of about 1400 MPa with 15% elongation. However, also this composition has a considerable amount of alloying elements like Mo and Ni. The purpose of adding to costly elements like Ni is to stabilize the retained austenite to provide the elongation and Mo is added to increase the toughness of the steel.

Thus, the prior art lacks the development of a continuously cooled bainitic steel which can deliver more than 1300 MPa UTS and at least 20% elongation without the addition of costly alloying addition like Ni and/Mo.

OBJECTS OF THE INVENTION

It is therefore the prime concern of the present invention to propose a suitable steel composition for producing high strength carbide-free bainitic steel which overcomes the disadvantages of having to add costly alloying elements as known from the prior art.

The isothermal holding at a fixed temperature for the bainite transformation requires a huge quantity of energy and is thus not very environmental friendly. This known method is also not feasible for higher productivity and continuous production. An object of the current innovation is to produce the steel in an environment friendly way by having the bainite transformation taking place during cooling of the steel. In this manner isothermal holding at a fixed temperature is no longer necessary which results in saving energy costs, reducing pollution and allows to produce through an existing industrial route.

Another object of the current invention is to propose a suitable chemistry of the steel which can deliver UTS of minimum 1300 MPa and at least 20% elongation.

Another object of the invention is to ensure the presence of 70-80% nano-structured bainite in the matrix along with 20-30% C enriched stable austenite to provide an excellent combination of strength and ductility.

Another object of the invention is to propose a method that can be carried out in an existing hot strip mill like plant.

SUMMARY OF THE INVENTION

According to a first aspect of the invention, one or more of the above objectives are met by providing a bainite steel with the following elements in weight %:

C: 0.25-0.55
Si: 0.5-1.8
Mn: 0.8-3.8
Cr: 0.2-2.0
Ti: 0.0-0.1
Cu: 0.0-1.2
V: 0.0-0.5
Nb: 0.0-0.06
Al: 0.0-2.75
N: <0.004
P: <0.025
S: <0.025
the balance being iron and unavoidable impurities.

With this composition it has proven that a high strength bainite steel can be obtained without the necessity of adding alloying elements like Ni and Mo as is known from the prior art.

In this composition the C content has a crucial role in developing the final microstructure and thus controls to a considerable extent the mechanical properties of the bainite steel. The C content is a very effective solid solution strengthener and has great effect on the stability of the retained austenite. To meet the objectives of the present invention the C content should be in the range as above indicated, but according to a preferred embodiment the C content of the bainite steel is in the range of 0.30-0.40 wt % and even more preferable in the range of 0.30-0.40 wt %. With these ranges an optimum of the effect of C in the composition according to the invention is obtained.

The Si content in the composition prevents the formation of cementite (iron carbide) due to its very low solubility in cementite. In the composition according to the invention the Si content is needed to realize a carbide-free bainite. At the same time Si enhances the solid solution strengthening effect.

The element Al in the composition also effectively hinders the formation of cementite for the same reason as Si, and can be used to at least partly replace Si for that purpose. For that reason the Si content may vary in the composition over a wide range dependent on the Al content.

If the Si content is taken at a level of 1.0-1.8 weight % or a more limited range of 1.2-1.7 weight %, which gives very good results with the final bainite steel, the Al content may be taken lower. The range of the Al content could be limited to 0.0-1.50 weight % or even as low as 0.0-0.2 weight % depending on the amount of Si.

Another reason to have a certain amount of Al in the composition is that it acts to deoxidize the steel during the steel making process. This helps in getting a more fluid slag which is easier to remove from the liquid steel bath.

The Mn in the composition of the bainite steel helps in avoiding the possible formation of polygonal ferrite by shifting the diffusional bay of the time-temperature-transformation (TTT) diagram to the right side on the time scale so that even with a moderate cooling rate ferrite is not allowed to form. A further effect of Mn content is that the bainite formation temperature can be lowered significantly by increasing the Mn content. This will facilitate the formation of fine bainite. However, the Mn content should not be too high since that could result in a steel that is difficult to weld.

Further Mn is an effective solid solution strengthener and can improve the yield strength of the steel significantly.

With a Mn content in the range of 0.8-3.8 weight % the diffusional bay of the time-temperature-transformation (TTT) diagram is shifted sufficiently to the right side so that the cooling rate normally applicable in a hot strip mill will not lead to the formation of ferrite, sufficiently fine bainite can be formed and also the solid solution strength will be high.

According to a preferred embodiment the Mn content is within a range of 1.0-2.5 weight %. In tests very good results were obtained with Mn in the range of 1.6-2.1 weight %.

The addition of Cr to the composition helps to improve the hardenability of the steel. During welding Cr can form carbides with the C present which will reduce the softening of the steel in the heat affected zone (HAZ). Good results with the composition according to the invention have been obtained with a Cr content of 0.7-1.5 weight % and also with a content of 0.9-1.2.

The Ti in the composition will react with the available N to form TiN which in turn forms fine TiCN precipitates which can improve the strength significantly by precipitation strengthening. The addition of Ti should however be limited because too much Ti would reduce the amount of C available to stabilize the retained austenite. For that reason the amount is kept low and tests have shown that the amount may even be lowered further to 0.08 or 0.07 weight % and even an amount of 0.04 weight % has shown to give the desired results.

Also the addition of Cu contributes to strengthening of the steel through precipitation strengthening. However, there is maximum to the Cu content since too much Cu will result in difficulties with coiling and moreover the use of Cu will increase the costs. Therefore a maximum is set at 1.2 weight %. Test samples without addition of Cu have shown to fulfill the objectives of the invention.

The elements Nb and V have great effect on the yield strength through the formation of fine sized carbides and carbo-nitrides which precipitate during or after coiling. These carbides can improve the strength of the steel significantly without deteriorating ductility. However, to avoid excessive strengthening and removal of carbon of the matrix the content is restricted to the given upper limit.

The invention further provides a method for manufacturing a bainite steel according to the above composition by heat treating the steel to form bainite steel comprising the steps of:

hot rolling a cast slab into strip,
cooling the strip to a temperature above the bainite start temperature,
coiling the strip at a temperature above the bainite start temperature,
cooling the coiled strip by natural cooling.

It has turned out that with the above method the bainite formation takes place when the strip is coiled, that is a situation wherein no further heat is applied. In the process of letting the coiled strip cool by natural cooling to ambient temperature the transformation to bainite takes place without the necessity of having to apply extra heat. This is a great advantage over the know methods wherein to have the bainite transformation take place large quantities of heat have to be applied to keep the temperature constant at 200° C. or higher for prolonged periods of time. Not only the advantage of considerable energy savings that are realized with the method, another clear advantage of the method is that the whole process can be a continuous process instead of a batch process.

The method further comprises the steps of
preparing liquid steel of the required composition,
casting the steel into a slab,
cooling the slab.

The cast and cooled slab may be reheated to 1250° C. for starting of the hot rolling operation. The final hot rolling temperature is at least 850° C.

After rolling the hot rolled strip is rapidly cooled to a temperature in the range of 400-550° C., which is well above the start temperature of the bainite formation. This allows to coil the strip at a temperature in the range of 350-500° C. which is still for the greater part above the start temperature of the bainite formation and prevents that the strip is cooled too rapidly which may result in an incomplete bainite transformation.

With the method of the invention the final bainite steel obtained after cooling the coiled steel to ambient temperature is carbide-free and has a microstructure with 15-30% of retained austenite and with bainite plates with a thickness of less than 100 nm. With 70-85% carbide free bainite and 15-30% retained austenite in the final bainite steel according to the invention a strength of at least 1300 MPa and an elongation of at least 20% is realized. The hardness of the steel is at least 415 HVN.

DESCRIPTION OF THE INVENTION

Figure 1:
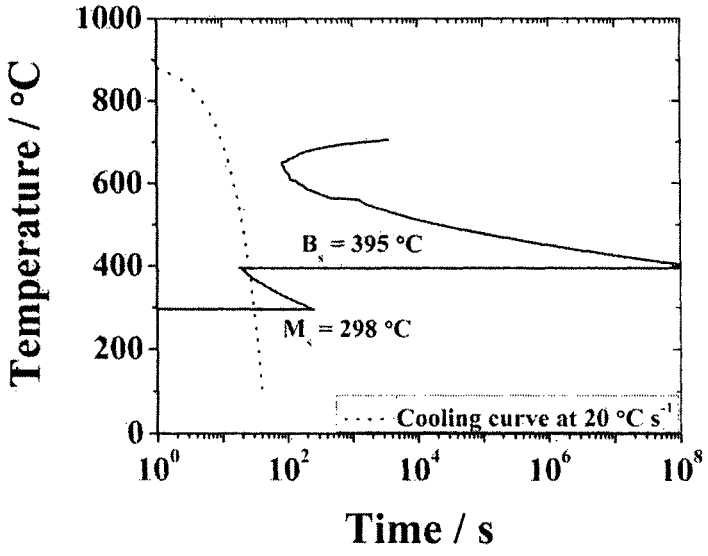
FIG. 1 Calculated TTT diagram for the designed steel

In FIG. 1 a TTT diagram is shown for a sample with a composition within the ranges given in Table 1 below.

TABLE 1

| | Range of compositions | | | | | | | | | |
|---|---|---|---|---|---|---|---|---|---|---|
| | C | Si | Mn | Cr | Ti | Cu | V | Nb | Al | N |
| Min | 0.25 | 0.5 | 0.8 | 0.2 | 0.0 | 0.0 | 0.0 | 0.0 | 0.01 | 0.001 |
| Max | 0.55 | 1.8 | 3.8 | 2.0 | 0.1 | 1.2 | 0.5 | 0.06 | 2.75 | 0.004 |

In the diagram $B_s$ and $M_s$ stand for respectively bainite start temperature and martensite start temperature. It can be seen from this figure that a minimal cooling rate 20° C. $sec^{-1}$, which is typical of any hot rolling mill, is capable enough to avoid the diffusional bay and in turn avoid the chance of formation of high temperature products like ferrite. The difference between $B_s$ and $M_s$ temperatures provides a reasonably wide processing window to carry out the method for producing bainite.

Figure 2:
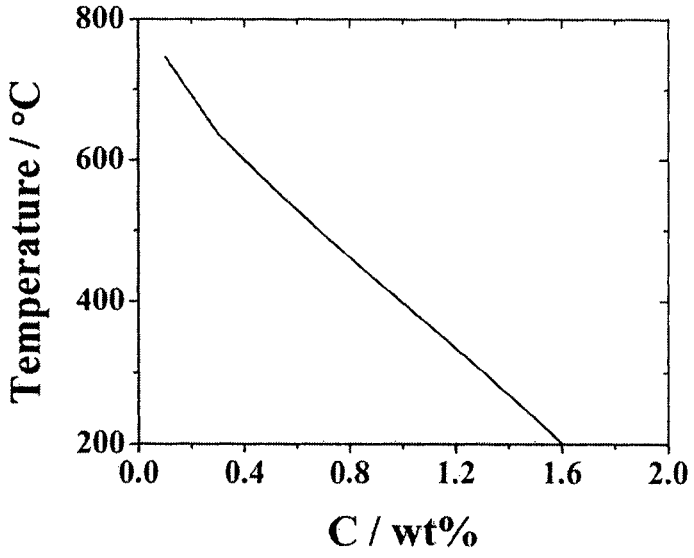
FIG. 2 Calculated $T_0$ curve for the designed steel composition

The $M_s$ will further be suppressed by the formation of bainite where due to the rejection of C from bainitic ferrite, adjacent austenite gets enriched with C, as denoted by the $T_0$ curve presented in FIG. 2.

From FIG. 2, it can be seen that the lower the transformation temperature, the higher is the enrichment of C in austenite. Consequently all the austenite is expected to be retained till the cessation of bainitic transformation. A sufficiently lower $B_s$ also provides the chance to produce lower bainite which is finer in nature and can contribute for higher strengthening.

During the progress of bainitic transformation, the whole of the austenite grain does not transform instantaneously to bainite. It is a gradual process; when the first plate of bainite forms, it rejects its excess carbon which it can not accommodate into the adjacent austenite. Further advancement of transformation therefore is associated with a lowering of free energy due to the higher carbon content of austenite from which bainite forms. Finally a time is reached when the free energies of both residual austenite and bainitic ferrite of the same composition becomes identical and therefore any further transformation becomes thermodynamically impossible. $T_0$ represents the locus of all the points, on a temperature versus carbon concentration plot, where the stress-free austenite and ferrite of identical composition have the same free energy. The bainitic transformation can progress by successive nucleation of subunits of bainitic ferrite till the carbon concentration in the remaining austenite reaches to its limit which is defined by the $T_0$ curve. The maximum amount of bainite which can be produced at any given transformation temperature is restricted by the retained austenite carbon concentration which can not exceed the limit given by the $T_0$ curve.

In this approach, bainitic transformation is made to occur at such a temperature where the diffusion of any elements except carbon is extremely negligible. Hence it can be considered that during bainitic transformation no other diffusional reaction interacts with it and the temperature is high enough for restricting other diffusionless transformation product. The carbon enrichment in austenite from adjacent bainitic-ferrite plates makes it thermally stable at room temperature and it will only transform to martensite during deformation exhibiting a TRansformation Induced Plasticity (TRIP) effect.

Figure 3A:
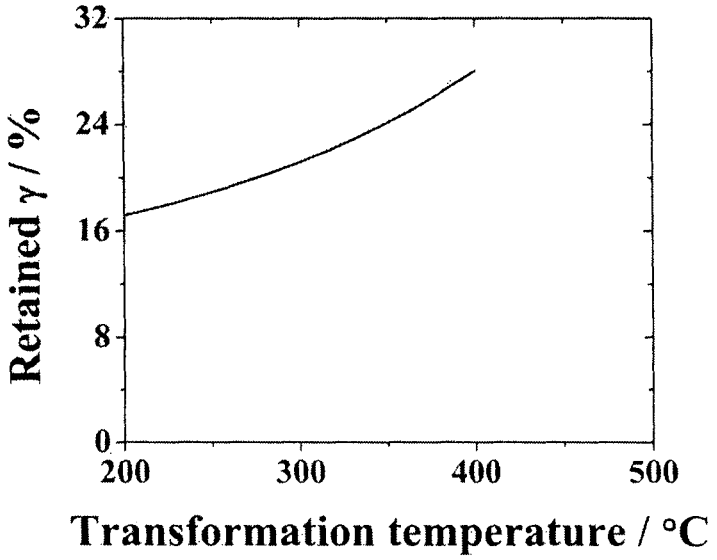
FIG. 3*a* Calculated amount of retained austenite as a function of isothermal transformation temperature FIG. 3*b* Calculated ratio of film type to blocky type austenite as a function of isothermal transformation temperature FIG. 4 Calculated strength of the designed steel FIG. 5 Schematic diagram of the hot rolling operation FIG. 6 Microstructure of the bainitic steel (a) Optical and (b) SEM FIG. 7 TEM photograph of the microstructure showing nanoscale bainite with high dislocation density FIG. 8 XRD profile (experimental along with simulated) of the continuously cooled sample FIG. 9 Tensile test results of three samples exposed to continuous cooling transformation after hot rolling.
Figure 3B:
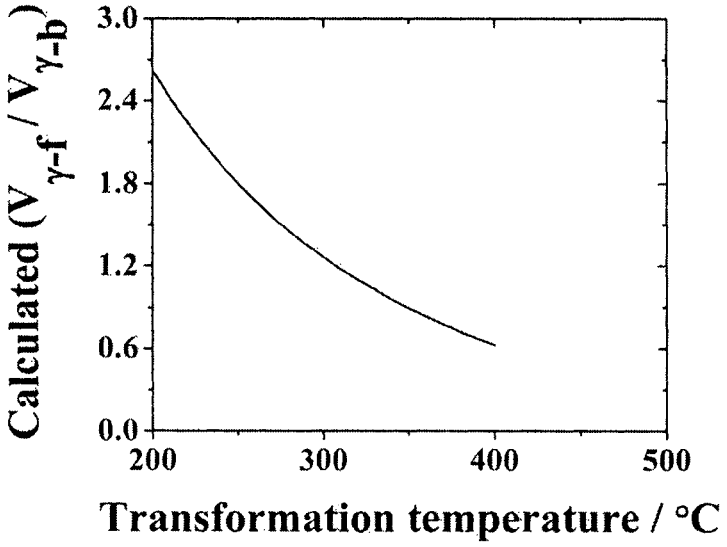

FIG. 3*a* represents a theoretical calculation of the amount of retained austenite after bainitic transformation at different isothermal temperatures whereas FIG. 3*b* shows the calculated ratio between the blocky and film type austenite. In the FIG. 3*b*, volume fraction of blocky and film type austenite are represented by $V_{\gamma\text{-}b}$ and $V_{\gamma\text{-}f}$, respectively. From FIG. 3*a* and FIG. 3*b* it is evident that the lower the transformation temperature is, the lower will be the amount of austenite which is detrimental for the expected TRIP effect and final elongation value. On the other hand, lower the transformation temperature, higher the ratio between films to blocky austenite which is required for the good ductility behavior. During TRIP effect, austenite transforms to martensite and the material gets work hardened. As a consequence, it is essential to have a certain amount of austenite remain untransformed at ambient temperature so that TRIP effect can occur.

It can also be found from FIG. 3 that at temperature 350° C., the calculated amount of retained austenite is approximately 24% and the ratio between the thin to blocky austenite is 0.9. At further lower temperature, the kinetics of the transformation becomes very sluggish and further reduction in the amount of retained austenite is not very much expected.

TABLE 2

| Composition in wt % for the 4 casts | | | | | | | | | | | |
|---|---|---|---|---|---|---|---|---|---|---|---|
| Heat number | C | Mn | Si | Cr | S | P | Al | Ti | Ni | Mo | Co |
| 1 | 0.37 | 1.84 | 1.65 | 0.92 | 0.01 | 0.03 | 0.054 | 0.068 | 0.014 | 0.024 | 0.005 |
| 2 | 0.345 | 1.97 | 1.29 | 1.03 | 0.007 | 0.015 | 0.036 | 0.017 | 0.01 | 0.01 | 0.001 |
| 3 | 0.355 | 2.01 | 1.46 | 1.04 | 0.007 | 0.016 | 0.038 | 0.017 | 0.01 | <0.005 | 0.001 |
| 4 | 0.32 | 1.94 | 1.55 | 1.01 | 0.01 | 0.03 | 0.01 | 0.04 | 0.01 | 0.01 | 0.001 |

Figure 4:
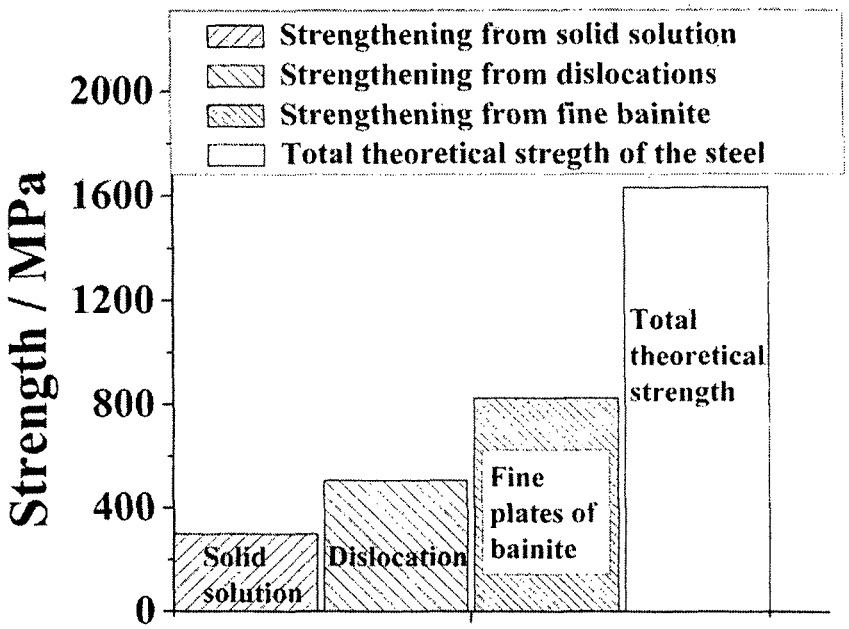

FIG. 4 represents the strength of the alloy which shows that the calculated total strength of the designed steel could exceed 1500 MPa. The major source of strengthening is coming from the ultra fine bainite plates. Another major source of strengthening is from the dislocation density which was calculated to be in the range of $4\text{-}6\times10^6$. Since there are some approximations and assumptions, the actual strength will be below the calculated strength. As there is very little knowledge available for bainitic transformation during continuous cooling, all the calculations were carried out at many different temperatures considering isothermal nature of transformation and then extrapolated to the continuous cooling situation.

Four 40 kg heats were made in vacuum induction furnace. The chemical compositions of these four casts are given in Table 2 below.

Subsequently, the cast steels were forged to 40 mm thickness and homogenized at 1100° C. for 48 hours after which the steels were cooled along with the furnace. All the experiments were carried out with this homogenized steel.

Figure 5:
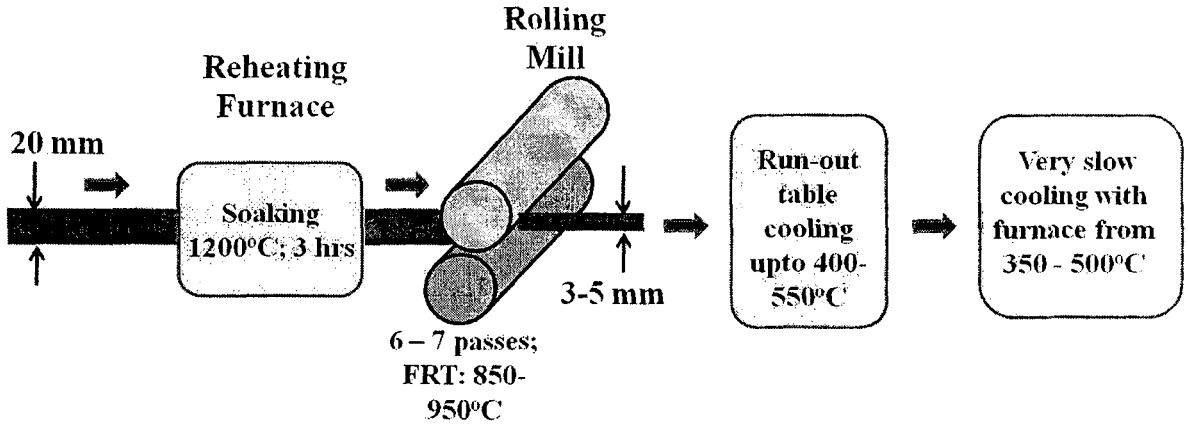

Small pieces of samples (150 mm×100 mm×20 mm) were cut for hot rolling in an experimental rolling mill. The soaking was done at 1200° for 3 hours. The rolling operation was completed within 6-7 passes, keeping the final rolling temperature at about 850-900° C. Throughout the experiments, temperature was monitored with laser radiation pyrometer. After the hot rolling, the samples were kept on run-out table where water jet cooling was applied till a temperature of 400-550° C. is reached and finally the samples were kept inside a programmable furnace where very slow cooling rate was applied to simulate the actual coil cooling situation. The cooling rate of a coil after coiling in downcoiler in hot strip mill was first measured with radiation pyrometer over a long period of time and similar cooling rate was simulated in furnace for the simulation purpose. The temperature of the furnace for coiling simulation was kept within 350-500° C. Schematic diagram of the entire hot rolling process is shown in FIG. 5. The hot rolled thickness was about 3.0 mm.

Figure 6:
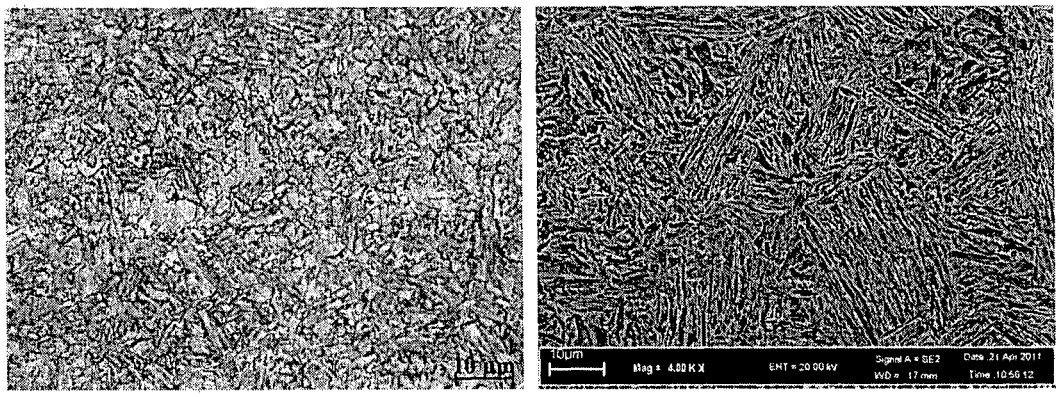
Figure 7:
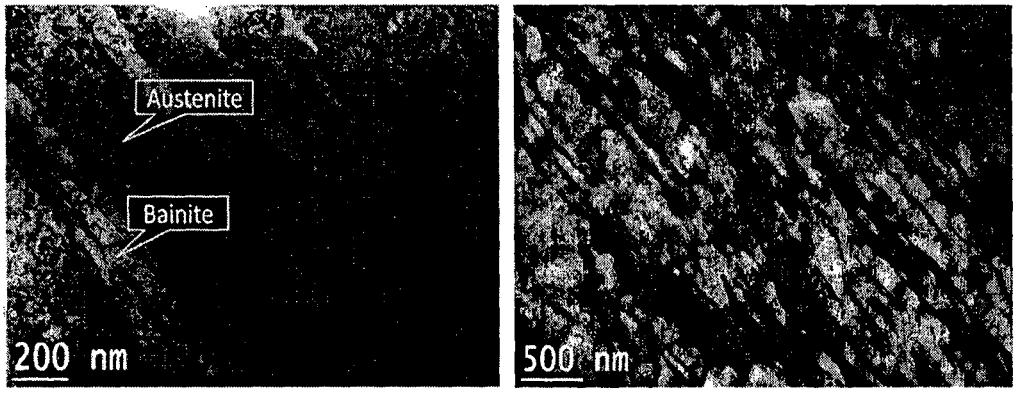

Samples for metallographic observation were cut from the rolling plane of one end of the heat treated samples. The samples were polished using standard procedure, etched with nital and the microstructures are reproduced here in FIG. 6 where FIG. 6*a* is the optical microstructure and FIG. 6*b* is the SEM photograph. Image analysis of the optical microstructures was carried out with the help of Axio-Vision Software version 4 equipped with Zeiss 80 DX microscope and shows the presence of significant amount of bainite (~75%) along with some retained (~25%) austenite. The products of diffusional transformation, e.g. ferrite, cementite were not seen and the bainite thus produced is a carbide-free bainite. The bainite plate thicknesses, as can be observed from the TEM photograph presented in FIG. 7, are less than 100 nm and the structure is highly dislocated.

The volume fraction and the lattice parameter of retained austenite were calculated from the X-ray data by using commercial software, X'Pert High Score Plus. The X-Ray Diffraction analysis results are shown in Table 3 below.

TABLE 3

| Volume fraction of different phases along with C in austenite | | | |
|---|---|---|---|
| Austenite/ wt % | C in austenite (from XRD)/ wt % | C in austenite (from $T_0$)/ wt % | Ferrite/ wt % |
| 22 ± 1.4 | 1.07 ± 0.06 | 0.99 | 79 ± 2.1 |

Figure 8:
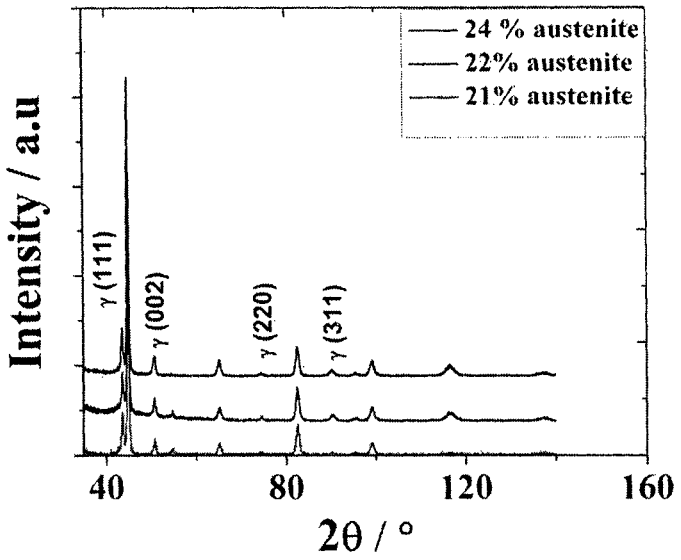

FIG. 8 represents the calculated and experimentally obtained XRD profiles along with the differences between these two. During the XRD analysis, it was assumed that whatever ferrite is present is only bainitic ferrite as the diffusional bay and its products were bypassed. From the Table 3, it is apparent that the C content of retained austenite is higher than that predicted from calculated $T_0$ curve shown in FIG. 2. It should be kept in mind that the $T_0$ curve was calculated at isothermal condition and the actual experiments were carried out in continuous cooling form producing different austenites with different C concentration. These different austenites are not separable by XRD and XRD indicates average C concentration only.

After continuous cooling to room temperature, hardness measurement was to carried out in Vicker's Hardness tester using 30 kg load. The hardness value turned out to be 425±9 VHN which is an averaged out value of 100 readings from four different hot rolled and continuously cooled samples. See Table 4 below for all the mechanical properties (hardness, YS, UTS, uniform elongation, total elongation). The ultimate tensile strength is even more than 1350 MPa.

TABLE 4

| Mechanical properties of the 4 casts | | | | | |
|---|---|---|---|---|---|
| Hardness/ VHN | YS/ MPa | UTS/ MPa | YS/ UTS | Uniform elongation/% | Total elongation/% |
| 425 ± 9 | 864 ± 28 | 1366 ± 4 | 0.63 | 13.6 ± 0.5 | 22 ± 0.7 |

Figure 9:
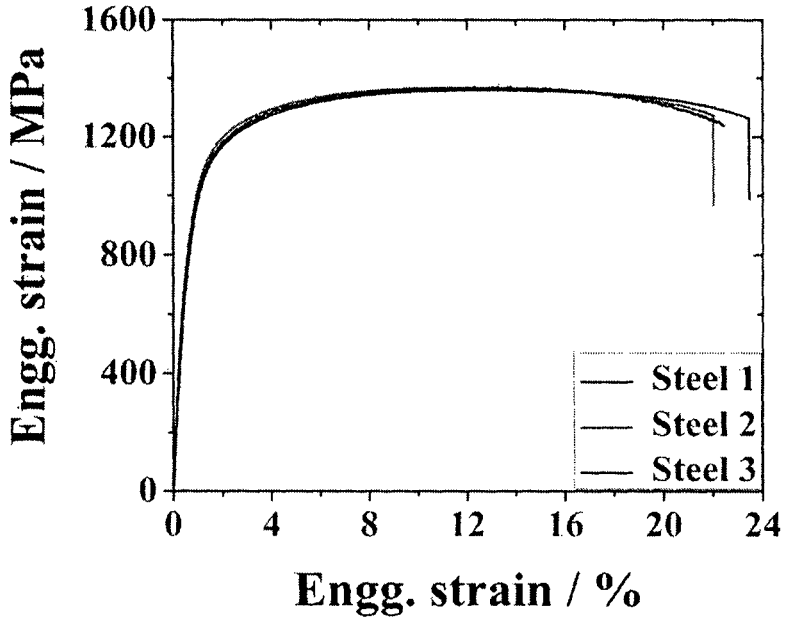

Standard tensile samples were prepared from the steel following the ASTM procedure [ASTM E8] for standard samples of 50 mm gauge length and tested in Instron tensile testing machine (Model number: 5582). FIG. 9 shows the results of the first three samples. From this figure, it is evident that the bainite steel according to the invention has an outstanding combination of tensile strength (>1300 MPa) with more than 20% elongation.

We claim:

1. A bainite steel comprising the following elements in weight %:

C: 0.30-0.50
Si: 1.0-1.8
Mn: 1.0-2.5
Cr: 0.7-1.5
Ti: 0.0-0.08
Cu: 0.0-1.2
V: 0.0-0.5
Nb: 0.0-0.06
Al: 0.0-1.50
N: <0.004
P: <0.025
S: <0.025 the balance being iron and unavoidable impurities, wherein the bainite steel comprises no added alloying Ni or Mo, wherein the bainite has a microstructure with bainite plates with a thickness of less than 100 nm, and wherein the steel has an ultimate tensile strength of at least 1350 MPa, wherein the bainite steel is formed by:

casting a slab from a liquid steel of the composition;

cooling the slab;

reheating the cooled slab to 1250° C.;

hot rolling a cast slab into a strip at a temperature of 850° C.; and coiling the strip of steel at a temperature above the bainite start temperature in the range of 350° C.-500° C., and continuously cooling the coiled strip by natural cooling, and wherein no further heat is applied during the step of continuously cooling the coiled strip such that the slab transforms to bainite steel during the cooling the coiled strip.

2. The bainite steel according to claim 1, wherein one or more of the following elements are present in weight %:

C: 0.30-0.40
Si: 1.2-1.7
Mn: 1.6-2.1
Cr: 0.9-1.2
Ti: 0.0-0.07
Al: 0.0-0.2.

3. The bainite steel according to claim 1, wherein the steel has a hardness of at least 415 VHN.

4. The bainite steel according to claim 1, wherein the steel has at least a total elongation of 20%.

5. The bainite steel according to claim 1, wherein the steel has a microstructure with 15-30% of retained austenite.

6. The bainite steel according to claim 1, wherein the bainite steel is 70-85% carbide-free bainite.

7. The bainite steel according to claim 1, wherein the bainite steel comprises 70-80% nano-structured bainite.

8. The bainite steel according to claim 1, wherein the Ti and N react to form TiN which in turn forms fine TiCN precipitates.

9. The bainite steel according to claim 1, wherein the steel has a dislocation density in the range of $4\text{-}6\times10^{6}$.

10. The bainite steel according to claim 1, wherein N is present in a weight % of 0.001-0.004.

11. The bainite steel according to claim 1, further comprising, prior to coiling the strip, cooling the strip formed from the slab to a temperature above the bainite start temperature in the range of 400-550° C.

12. The bainite steel according to claim 1, wherein Cu is present in a weight % of 0.1-1.2.

13. The bainite steel according to claim 1, wherein V is present in a weight % of 0.1-0.5.

* * * * *